US007591772B2

(12) United States Patent
Shillington

(10) Patent No.: US 7,591,772 B2
(45) Date of Patent: Sep. 22, 2009

(54) EXERCISE DEVICE INCLUDING COLLAR COUPLING

(76) Inventor: Richard A. Shillington, 5955 Lake Vista Dr., Bonsall, CA (US) 92003-6104

( * ) Notice: Subject to any disclaimer, the term of this patent is extended or adjusted under 35 U.S.C. 154(b) by 0 days.

(21) Appl. No.: 11/707,272

(22) Filed: Feb. 16, 2007

(65) Prior Publication Data

US 2008/0200316 A1 Aug. 21, 2008

(51) Int. Cl.
*A63B 21/072* (2006.01)

(52) U.S. Cl. ..... 482/107; 482/106; 482/148

(58) Field of Classification Search ..... 482/106, 482/107

See application file for complete search history.

(56) References Cited

U.S. PATENT DOCUMENTS 700,412 A * 5/1902 Fischer ..... 279/75
1,829,760 A * 11/1931 Santiago ..... 294/86.22
2,429,202 A * 10/1947 Estill et al. ..... 285/277
2,514,760 A * 7/1950 Hanson et al. ..... 294/86.31
4,141,117 A * 2/1979 Van Gompel ..... 24/136 R
4,579,337 A * 4/1986 Uyeda ..... 482/107
4,822,034 A * 4/1989 Shields ..... 482/106
4,893,810 A * 1/1990 Lee ..... 482/107
5,050,413 A * 9/1991 Stillwagon et al. ..... 70/386
5,098,361 A * 3/1992 Danylieko ..... 482/97
5,141,355 A * 8/1992 Stillwagon ..... 403/325
5,163,887 A * 11/1992 Hatch ..... 482/107
5,197,314 A * 3/1993 Stillwagon et al. ..... 70/386
5,295,934 A * 3/1994 Collins et al. ..... 482/107
5,697,871 A * 12/1997 Landfair ..... 482/82
5,735,777 A * 4/1998 Benoit et al. ..... 482/93
6,007,268 A * 12/1999 Whittington et al. ..... 403/328
6,059,700 A * 5/2000 Ellenburg ..... 482/107
6,129,650 A * 10/2000 Wedge, Jr. ..... 482/139
6,415,476 B1 * 7/2002 McCoy ..... 16/257
6,439,797 B1 * 8/2002 Campbell ..... 403/321
6,679,816 B1 * 1/2004 Krull ..... 482/107
6,902,517 B1 * 6/2005 Brown et al. ..... 482/107
2004/0072661 A1 * 4/2004 Krull ..... 482/106
2004/0242385 A1 * 12/2004 Emick ..... 482/106
2005/0101453 A1 * 5/2005 Jeneve et al. ..... 482/106
2005/0187079 A1 * 8/2005 Diakonov et al. ..... 482/106
2007/0037667 A1 * 2/2007 Gordon ..... 482/51
2007/0042879 A1 * 2/2007 Panagos ..... 482/106
2007/0161474 A1 * 7/2007 Lippitt ..... 482/106
2007/0225132 A1 * 9/2007 Liu ..... 482/106
2007/0249475 A1 * 10/2007 Cao ..... 482/107

* cited by examiner

*Primary Examiner*—Loan H Thanh
*Assistant Examiner*—Robert F Long
(74) *Attorney, Agent, or Firm*—The Nath Law Group; Jerald L. Meyer; Jonathan A. Kidney

(57) ABSTRACT

An exercise device comprises a bar, pairs of weights comprising weight collars which can be removably secured to either end of the bar, and a coupling for each weight collar. One of the bar or the weight collar has means for receiving a detent, e.g., a circular groove on an inner diameter of an axial central bore. A locking device is positioned in the other one of the bar or the weight collar. In arriving at a locked position, a spring-biased, axially disposed actuator pushes ball bearing detents, by camming action, radially outwardly through an aperture in the component housing the locking device to rest in a radially adjacent circumferential groove. The actuator is depressed to permit radially inward movement of the detents so that the weight collars caps can be removed.

24 Claims, 16 Drawing Sheets

EXERCISE DEVICE INCLUDING COLLAR COUPLING

FIELD OF THE INVENTION

The present subject matter relates generally to an exercise device and to a coupling system for releasably securing a weight to an end of a bar.

BACKGROUND OF THE INVENTION

Exercise devices such as barbells are used for weight training. The barbell comprises a bar having a first weight. A user may do weightlifting exercises with the bar alone for training. Alternatively, the user selects a pair of weights and releasably secures one weight to each end of the bar. A number of pairs of differently sized weights are provided so that a user may select a total weight with which to exercise. In another form of exercise device, a barbell is formed with a yoke portion. Rather than doing lifting exercises, the user places the barbell over the shoulders, with the yoke going behind the neck. The user may perform trunk twists and bends using the bar to maintain positions of the arms and torso for maximum effectiveness of the exercises. The bar is configured for adding weight inside or outside and particularly at its ends for increasing the rotational moment of inertia of the bar to give the effect of greater weight.

An example of a trunk exerciser is shown in U.S. Pat. No. 5,312,314. An exercise bar includes a yoke. In one form, the exercise bar comprises five sections that fit in a carrying case. In one embodiment, weights can be inserted in hollow ends of the bar. End caps are press fit over the ends of the bar. The range of weight that can be provided is necessarily limited by the space inside the ends of the bars. In another embodiment, weights are inserted over an exterior of each end and held in place by a collar including a setscrew. The end cap and the setscrew each provide for an interference fit rather than positively retaining the cap or collar in place with a stop element. In another form, weights are retained on each end of the bar by a screw with a broad head threaded into an end of the bar. The screw does not permit quick release or engagement of the retained weights.

U.S. Pat. No. 5,295,934 and U.S. Pat. No. 6,007,268 each disclose a locking release collar assembly received over a bar. The collar is adapted to be axially received on and to be removably fixed at a selected location axially between a weight mounted on the bar and an end of the bar. The release collar includes an assembly in which radially moveable ball detents are cammed into frictional engagement with the shaft and rest in a groove. A spring-biased collar member is moved axially to permit the ball detents to move radially outwardly out of the groove to unlock the release collar. In this construction, a weight cannot be mounted on an end of a bar. The weight must move axially inwardly of the end of the bar. The release collar is an additional component which must be provided in addition to the weight and the bar. This structure does not provide for securing a weight to an end of the bar. As a practical matter, a user must apply force to circumferentially opposed portions of the collar. These collars are not operated by a single application of force to a single location such as a button.

U.S. Pat. No. 4,854,576 discloses weights each integral with a collar that slides on to the end of the bar. A spring clip inside the bar radially biases each of two radially opposed detent pins outwardly through holes in the bar into recesses in the collar. To release a weight, a user must push fingertips through the holes to push the pins into the bar. There is no mechanism to operate the pins outside of the holes or to keep the pins in a radially inward position when the user's fingers are removed. Also, the collar exerts a shearing force against the pins which can also exert a moment on each pin tending to pull the pin from the spring clip. A detent mechanism immune to the generation of force moments is not provided.

The prior art does not disclose a system for retaining a weight on an end of a bar which is positively operable between an engaged and disengaged position and in which in a retainer assembly separate from the bar or the weight is not required.

The above cited art discloses bars which may be used with a pair of weights that is selected from a set of a plurality of pairs of weights. Systems utilizing a set of pairs of weights may include a rack or cabinet to support the pairs of weights. However, the weights generally rest on a rack and do not engage a support in a manner similar to that in which the weights would engage the bar.

SUMMARY OF THE INVENTION

Briefly stated, in accordance with embodiments of the present invention, an exercise device and a coupling for releasably securing a weight collar to an end of a bar are provided. The bar has an end to receive the weight collar. A coupling mechanism may be included in either the bar or the weight collar. The mechanism cooperates with a stop in the other of the bar or the weight collar.

An assembly to releasably secure the weight collar to the bar includes an axially extending first recess formed in either the bar or the weight collar. The recess is coaxial with the bar and communicates with a radial surface at a proximal end of the assembly. An actuator, which may comprise a generally cylindrical body, is axially movable within the first recess. A detent means located in said actuator cooperates with the actuator to selectively engage stop means to prevent relative axial motion of said bar and said collar. The stop means is in the other of said bar and said collar. A recess in the actuator has a first depth along a first axial extent and a second depth along a second axial extent of said recess. The first depth is at least equal to a radial dimension of the detent means, and said second depth is less than the radial dimension of said detent means. Camming of the actuator against the detent means causes the detent means to engage the stop means. The first axial extent of the recess is in registration with the stop means when said actuator in a first axial position and the second axial extent is in registration with said stop means when the actuator is in a second axial position. An aperture communicates the recess with an exterior of the actuator so the detent means can engage the said stop means when said actuator is in said second axial position. The actuator is selectively maintained in one of said first and second positions.

BRIEF DESCRIPTION OF THE DRAWINGS

The present subject matter may be further understood by reference to the following description taken in connection with the following drawings.

DETAILED DESCRIPTION

Figure 1:
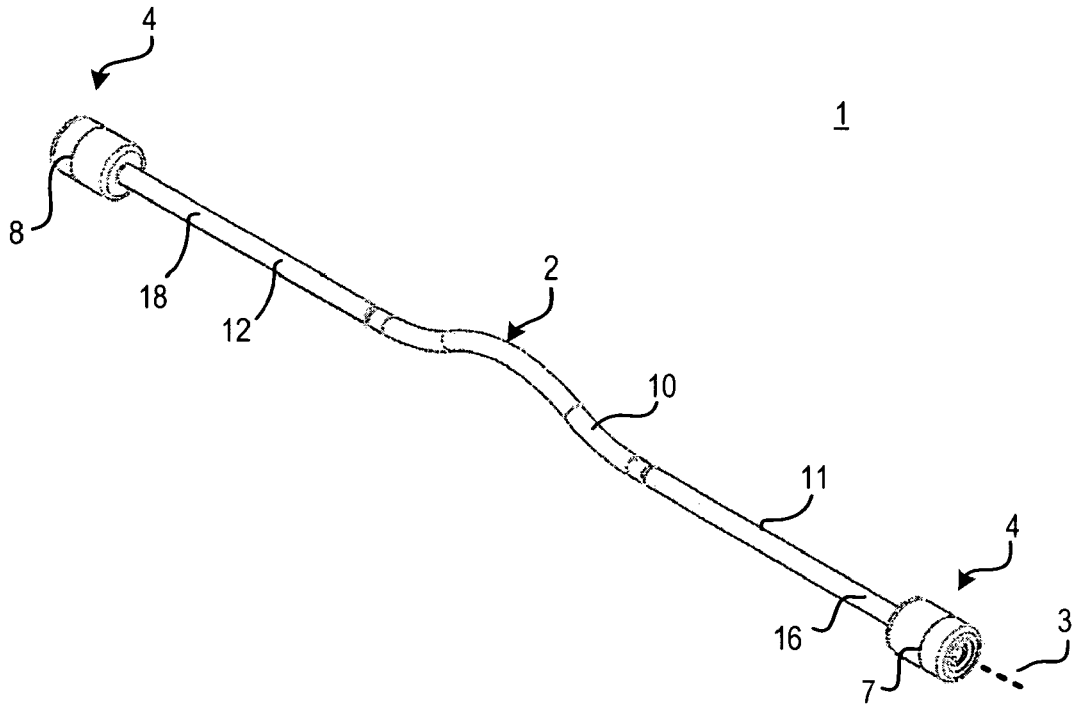
FIGS. 1 and 2 are respectively an isometric view and a plan view of a system in accordance with an embodiment of the invention comprising a bar and weights.
Figure 2:
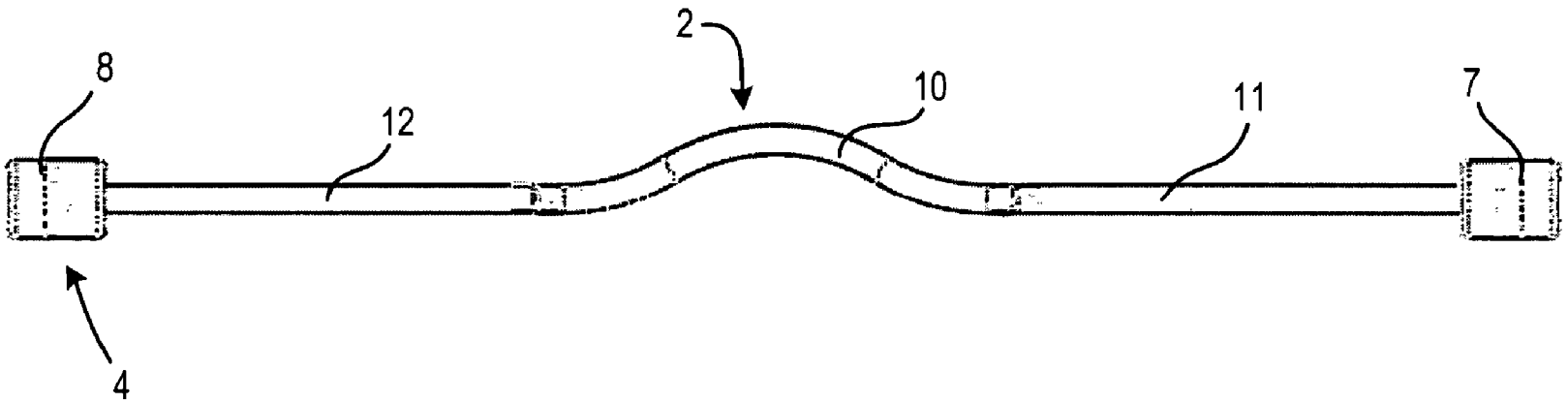

FIGS. 1 and 2 are respectively an isometric view and a plan view of an exercise device 1 constructed in accordance with an embodiment of the present invention. The exercise device 1 comprises a bar 2 and a pair of weights 4 which comprises weight collars 7 and 8, each releasably securable to an opposite end of the bar 2. Straight portions of the bar 2 lie on an axis 3. The exercise device 1 can be used, for example as a dumbbell. Alternatively, the exercise device 1 may be supported on the shoulders of a user performing trunk exercises. A plurality of pairs of weights 4 may be provided so that a user may select a total weight with which to exercise.

The bar 2 could be a hollow tube or a solid bar. To facilitate transportability, the bar 2 may comprise sections that are connected, such as by threads at threaded ends. In the present illustration, a central section 10 is surrounded by end sections 11 and 12. Other numbers of sections could be provided. For a dumbbell embodiment, the central section 10 may be straight. In an embodiment for trunk exercises, the central section 10 is provided with a curve to fit around a user's neck when the bar 2 rests on the user's shoulders. The bar 10 has first and second proximal ends 16 and 18. In the present description proximal describes a location at an end, and distal refers to a center of the bar 2. In accordance with this convention, a description of interaction of the weight collar 7 in the exercise device 1 will also describe the interaction of the weight collar 8.

The weight collars 7 and 8 are releasably secured to proximal ends 16 and 18 respectively. The weight collars 7 and 8 may each be regarded as first coupling members, and the proximal ends 16 and 18 may each be regarded as second coupling members. At each end of the bar 2, a mechanism, further described below with respect to FIG. 5 and other Figures, operates detent means to engage stop means, further described below with respect to FIG. 4 and other Figures. In an embodiment in which the mechanism is in each of the first coupling members, and the stop means is in each of the second coupling members. One convenient form of a detent is a ball bearing. A stop means could comprise a circular groove. The mechanism moves the detent radially to engage the groove and secure the first coupling member to the second coupling member in a first, engaged position. The mechanism is operated to move the detent radially to be removed from the groove in a second, disengaged position and release one of the weight collars 7 or 8.

Figure 3:
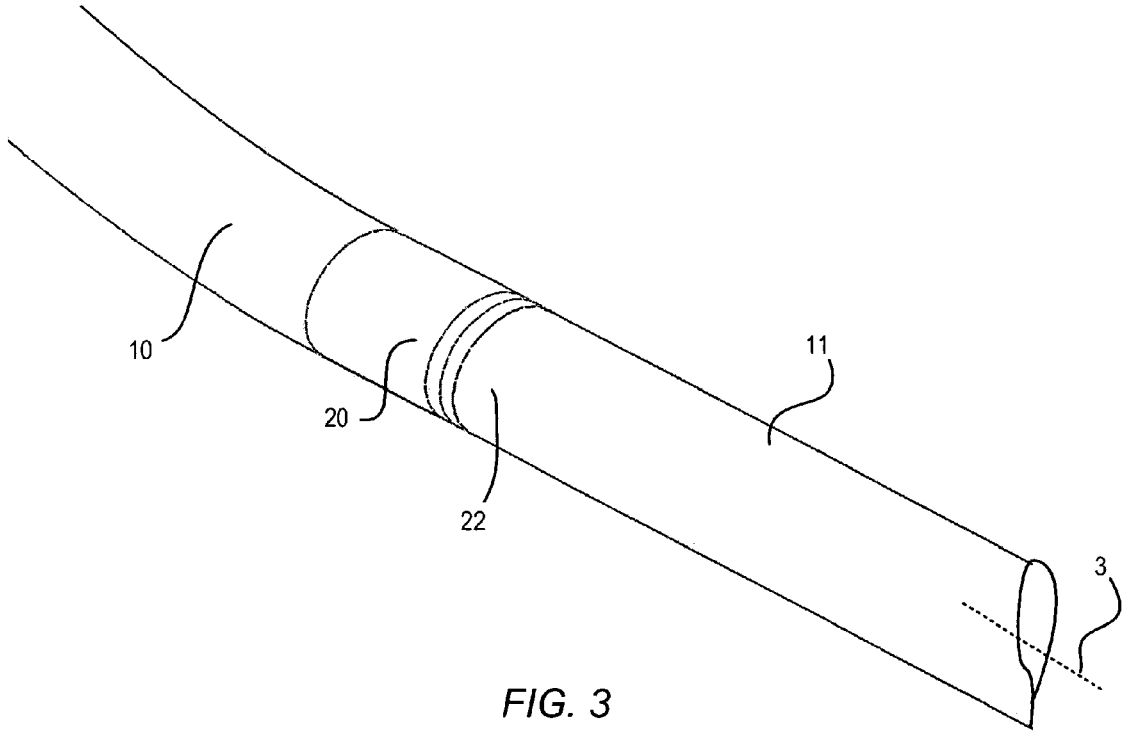
FIG. 3 is a partial detailed view of FIG. 2.
Figure 4:
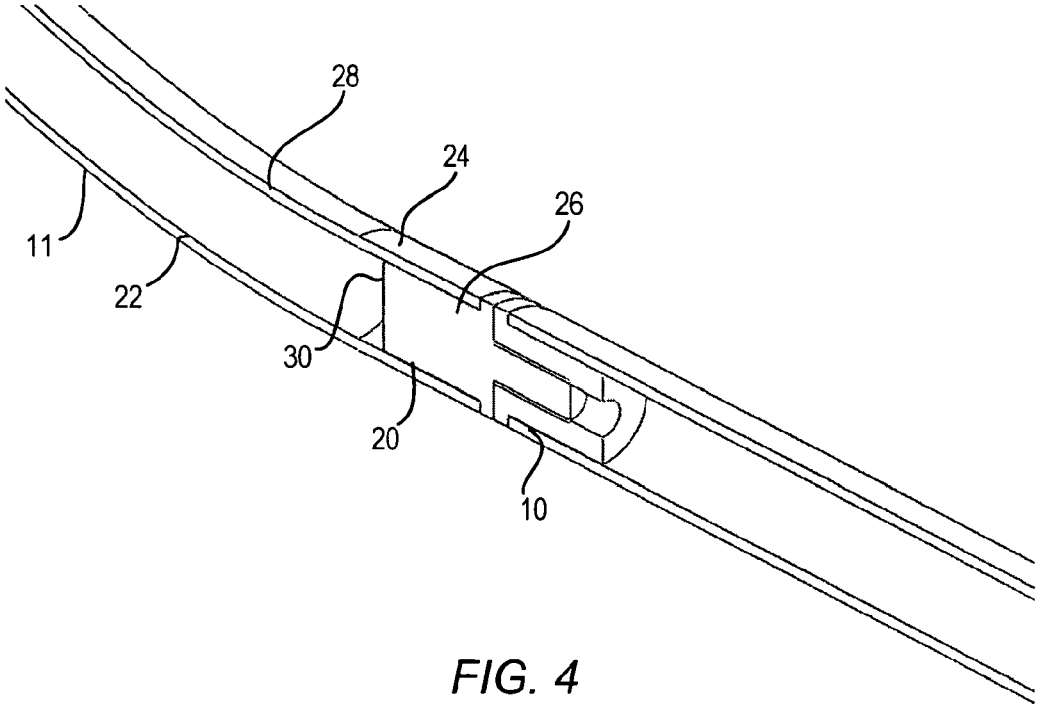
FIG. 4 is a cross sectional view taken along a diameter of the bar.

FIGS. 3 and 4 are respectively a partial detailed view of FIG. 2 and a cross sectional view taken along a diameter of the bar illustrating connection of the sections to the section 11. The section 12 is connected to the section 10 in the same manner. The section 10 has a proximal end 20, and the section 11 has a distal end 22. The proximal end 20 of the section 10 has a cylindrical plug 24 received therein. The plug 24 has a threaded, axially extending central bore 26. The distal end 22 of the section 11 contains a cylindrical plug 28 having a threaded coaxial cylindrical extension 30. The cylindrical plugs 24 and 28 may be press fit, welded or otherwise secured to the section ends 20 and 22 respectively. Mating, radially extending faces of the cylindrical plugs 24 and 28 are preferably perpendicular to the axis 3. To connect the section 11 to the section 10, the coaxial extension 30 is threaded into the central bore 26. If a "right handed" thread is used, this will be accomplished by a rotation in which the section 11 rotates counterclockwise with respect to the section 10. To disconnect the sections 10 and 11, rotation of the coaxial cylindrical extension 30 is counterclockwise with respect to the central bore 26.

Figure 5:
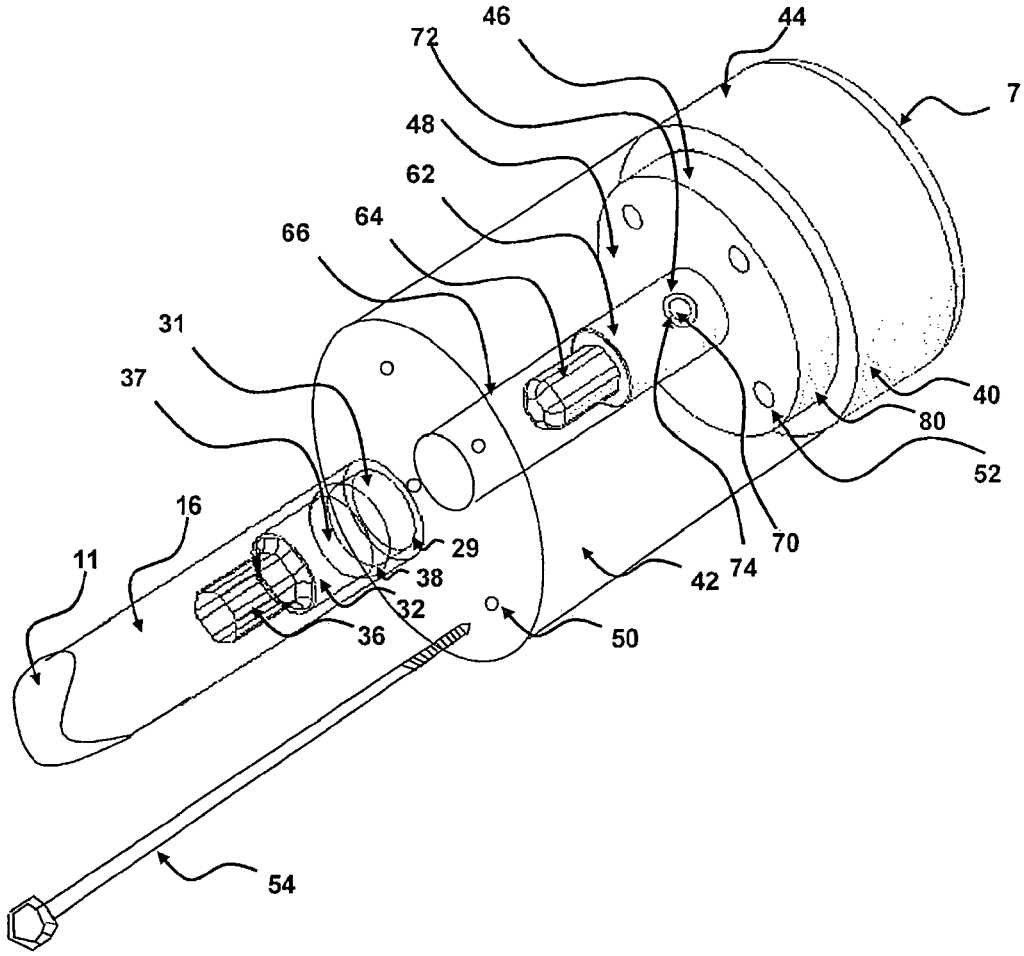
FIG. 5 is an isometric view, partially broken away, illustrating an end of a bar and a weight collar to be received on a bar.
Figure 6:
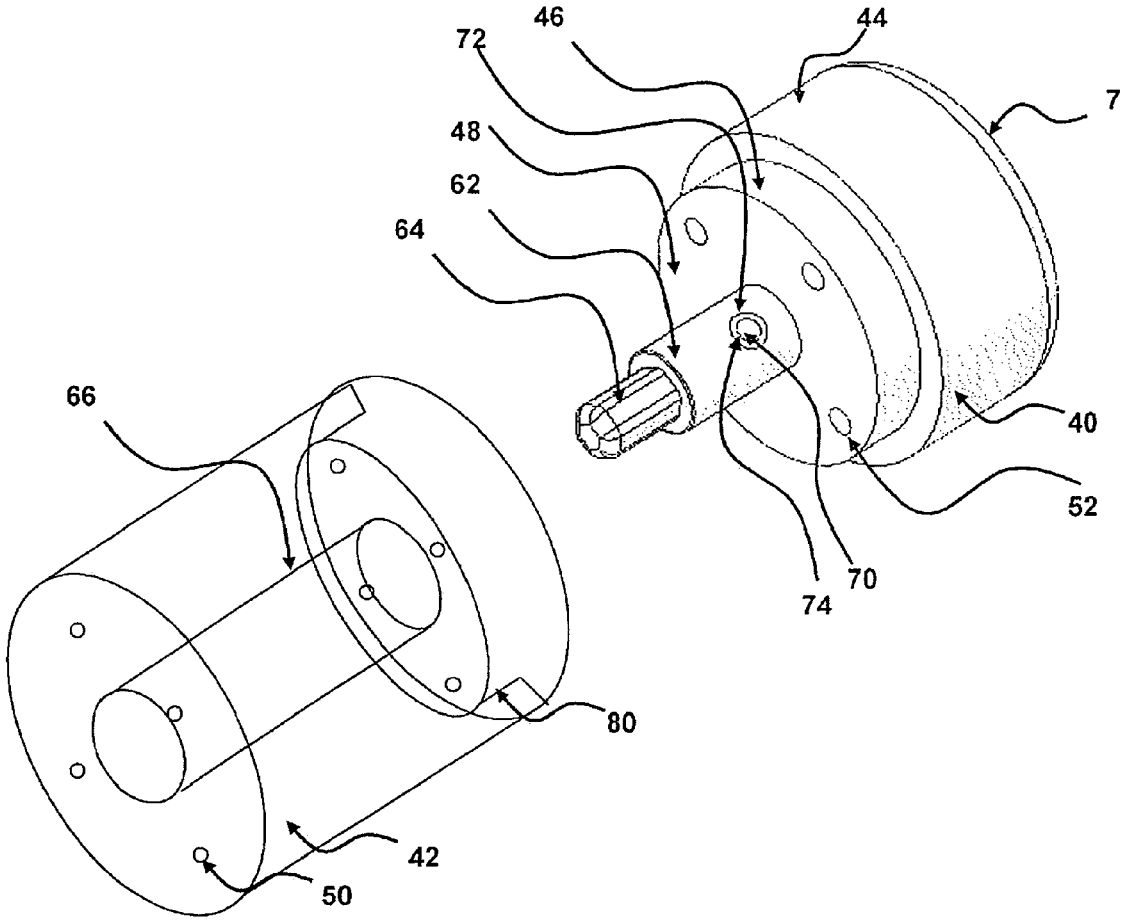
FIG. 6 is an exploded view of the weight collar of FIG. 5.

FIG. 5 is an isometric view, partially broken away, illustrating an end of a bar and a weight collar to be received on a bar. FIG. 6 is an exploded view, respectively, illustrating components of one form of weight collar 7. The following discussion is with respect to both FIGS. 5 and 6. In this embodiment, the above-mentioned mechanism, further described below, is included in the weight collar 7, and the stop means is included in the section 11. The proximal end 16 of the section 11 has an edge 29. An axial bore 31 communicating with the edge 29 has a preselected depth and an inner wall 32 to receive a projection, described below, from the weight collar 7. Distally beyond the axial bore 31 is an alignment socket 36 having a shape that will not permit rotation of a member mating in the socket. In the present illustration, the alignment socket 36 is hexagonal in a radial plane. Hexagonal sockets are commonly used in tools, but other shapes could be utilized. At a preselected distance distally from an opening of the axial bore 31, a stop means 37 is provided to cooperate with a mechanism further described below. The stop means 37 may conveniently comprise a circumferential groove 38 formed in the inner wall 32. The stop means 37 could comprise other structure for receiving detent means to prevent relative axial motion of the weight collar 7 with respect to the section 11. A groove is a convenient form of stop means since no particular rotational alignment of the section 11 with respect to the weight collar 7 is required.

The weight collar 7 provides a user with the option of releasably securing a preselected weight to an end of the bar 2 and includes a mechanism for releasably securing the weight collar 7 to the bar 2. The weight collar 7 comprises a weight cap 40 and a weight cylinder 42. In the present illustration, a separate weight cap 40 and a weight cylinder 42 are provided for improved manufacturability and to accommodate a total weight of the weight collar 7 while maintaining a limited radial dimension. The greater the weight of the weight collar 7, assuming the same material is used, the greater its volume must be. In order to maintain a limited radial dimension, the axial dimension of the weight cylinder 42 must be increased to provide for additional weight. In order to provide for a substantially constant axial length of the exercise device 1 increasing sizes of weight collars 7 extend further distally from the proximal end of the weight cap 40.

Maintaining a limited radial dimension and a substantially constant axial dimension of the exercise device 1 may provide an aesthetically desired appearance. This also facilitates design of efficient containers for sets of weights, thus enhancing portability of the exercise device 1. Since the weight cylinder 42 will surround the circumference of coupling mechanisms in the weight cap 40, in order to facilitate assembly of the weight cap 40, the auxiliary weight cylinder 42 is not joined to the weight cap 40 until after the weight cap 40 is assembled. Also, by using weight cylinders 42 of substantially constant diameters, a single version of a weight cap 40 may be manufactured to connect with any size of the weight cylinder 42, thus decreasing manufacturing and inventory costs. In embodiments in which the shape of the weight cylinder 42 will not adversely affect manufacturability, the weight cylinder 42 may be unitary with the weight cap 40.

In one form, the weight cap 40 has a first, proximal cylindrical section 44 and a second, distal cylindrical section 46 with a rear face 48. Axial bores 52 extend proximally from the rear face 48. The bores 52 may be internally threaded to capture ends of bolts 54, or other attachment mechanisms may be used to secure bolts 54 in weight cap 40. The second cylindrical section 46 may have a reduced diameter received in an annular flange, described below, in the weight cylinder 42. A plurality, e.g. four, of axial bores 52 extends proximally from the rear face 48. The weight cap 40 has a mating sleeve 62 projecting distally from the rear face 48 to be received in the axial bore 31 of the section 11. An anti-rotation plug 64 may be provided extending distally from the mating sleeve 62 to be received in the anti-rotation socket 36. A resilient washer 68 (FIG. 7*a*) may be located at the interface of the weight cap 40 and the weight cylinder 42 to prevent relative axial motion or vibration within the weight collar 7. In the present illustration the washer 68 is in a recess at a distal end of the weight cap 40. Other vibration damping means, e.g. a gasket, could be used.

An axially extending central recess 66 (FIG. 7*a*) extends through an interior portion of the weight cylinder 42. A detent 70, in a first position, extends radially beyond the mating sleeve 62. The detent 70 cooperates with the circumferential groove 38 to maintain the weight collar 7 in engagement with the bar 2. A retainer 72 renders the detent 70 captive in the mating sleeve 62. In a preferred form, in manufacture of the weight cap 40, an aperture 74 is provided in the mating sleeve 62 to receive the detent 70. The area of the mating sleeve 62 in the vicinity of the aperture 74 is swaged to form the retainer 72.

The weight cylinder 42 need not meet the mathematical definition of a cylinder. However, most practical embodiments of the weight cylinder 42 will meet the mathematical definition of a cylinder. In the present embodiment, the weight cylinder 42 has rounded edges at a distal end and has an annular flange 80 (FIG. 5) which receives the rear section 46 of the weight cap 40. Extending axially through the weight cylinder 42 are bores 50 positioned such that each bore 50 may be placed in registration with each bore 52 in the weight cap 40 and receive a bolt 54.

Figure 7A:
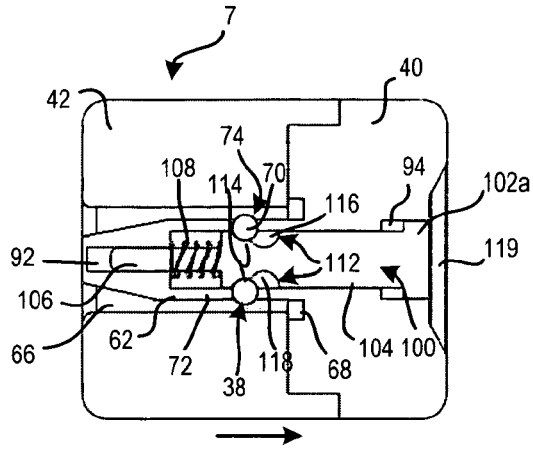
FIG. 7 consists of FIGS. 7*a*-7*c*, each of which is a cross sectional elevation illustrating a different form actuator disposition in a weight collar.
Figure 7B:
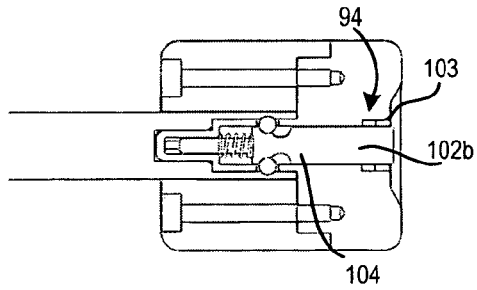
Figure 7C:
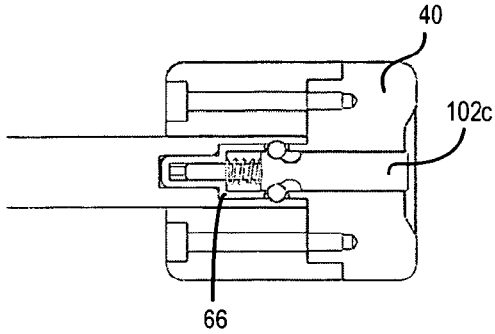

FIG. 7 consists of FIGS. 7*a*-7*c*, each of which is a cross sectional elevation illustrating a different form of weight collar. FIG. 7*a* represents the embodiment illustrated in FIGS. 5 and 6. The central axial chamber 66 extends from a proximal surface of the weight collar 7 sufficiently past to retainer 72 to permit housing of a distal end of actuator described below. An alignment socket 92 may be provided projecting distally from the central axial chamber 66.

The central axial chamber 66 houses an actuator 100. The actuator 100 is normally in a first position in which the detent 70 engages the circumferential groove 38, as illustrated in FIG. 7*a*. When the actuator 100 engages the detent 70, the weight collar 7 or the weight collar 8 will be locked on the bar 2. When the actuator 100 is in a second position, the detent 70 will not engage any stop means, and the weight collar 7 or 8 will be released with respect to the bar 2. The actuator 100 is preferably cylindrical. In the present illustration, the actuator 100 comprises a button 102*a* at a proximal end of the actuator 100 which has an expanded diameter with respect to a central section 104 to fit in the countersunk recess 94. At a distal end, the actuator 100 may include an alignment plug 106 of reduced diameter with respect to the central section 104 received in the alignment socket 92.

The actuator 100 includes a detent chamber 112 for each detent 70. Each detent chamber 112 comprises first and second recesses 114 and 116. The recesses 114 and 116 may be substantially hemispherical and conveniently formed by drilling. The depth of the first recess 114 has a dimension which will result in the detent 70 projecting through the aperture 74 (FIG. 5) sufficiently to engage stop means such as the groove 38 (FIG. 5). The second recess 116 has a depth dimensioned so that the detent 70 will not engage stop means and preferably not project radially beyond the sleeve 62. A wall of the second recess 116 comprises a camming surface 118 to urge the detent 70 in a radial direction when the actuator 100 is moved from the second position to the first position. To maintain the actuator 100 in the first position when the actuator 100 is not being operated, a biasing means 108 is provided. In the present illustration, the biasing means 108 comprises a coil spring surrounding the alignment plug 106 and located in the central axial chamber 66 between a distal end of the central section 104 and a distal end of the central axial chamber 66.

In the present embodiment, the proximal surface of the button 102*a* is distally displaced from the proximal surface of the weight collar 7. A recess 119 is formed in the proximal end of the weight collar 7. Positioning the button 102*a* in the recess 119 can help prevent accidental axial displacement of the actuator 100, which could lead to disengagement of a weight collar 7 or 8. Positioning of a proximal end of the actuator 100 is determined by the dimensions of the actuator 100, the central axial chamber 66 and the location of the retainer 72 on the mating sleeve 62. In each of FIGS. 7*a*-7*c*, a suffix is used on button 102 corresponding to the suffix of the Figure in which it appears. FIGS. 7*b* and 7*c* illustrate different options for positioning an actuator 100 in the weight collar 7.

In the embodiment of FIG. 7*b*, the button 102*b* has a diameter equal to that of the central section 104. An annular member 103 may be press fit, or otherwise fastened over the end of the button 102*b* to fill the countersunk recess 94 and provide for a button the width of the button 102*b*. In one embodiment, the annular member 103 could be a plastic collar. In one form, a different color plastic could be used for each different size of weight. In the embodiment of FIG. 7*c*, the components are dimensioned so that a button 102*c* projects from a proximal surface of a weight cap 40 surrounding the button 102*c* by, for example, 0.050". In this embodiment, there is no countersunk recess 94.

Figure 8:
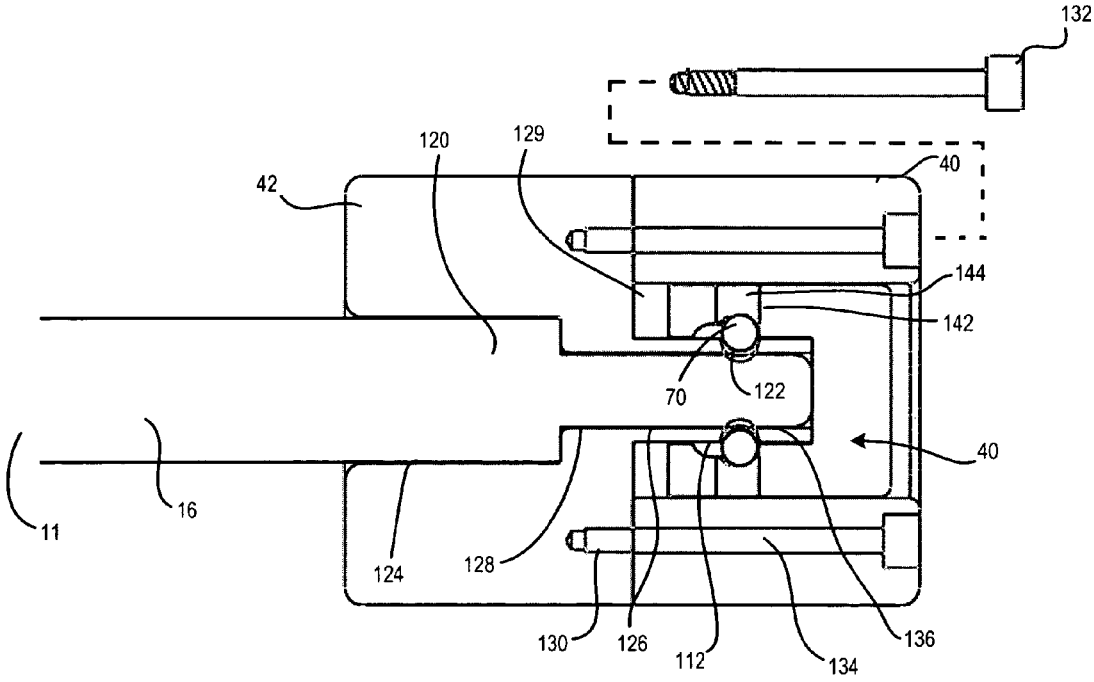
FIG. 8 is a cross sectional elevation in which a weight receives a bar, rather than a bar receiving a weight.

FIG. 8 is a cross sectional elevation in which a weight receives a bar, rather than a bar receiving a weight. The same reference numerals are used to denote components in earlier Figures. In the embodiment of FIG. 8, the end 16 of the section 11 terminates in a proximally extending cylinder 120. The cylinder 120 has a circumferential groove 122 adjacent a proximal end thereof. The groove 122 will function in a manner similar to the circumferential groove 38 of the embodiment of FIG. 5. The weight cylinder 42 is formed with a first cylindrical recess 124 to receive a diameter of the end 16. A second cylindrical recess 128 proximally extending from the first cylindrical recess 124 receives the extending cylinder 120. The recess 124 extends beyond the proximal end of the weight cylinder 42 and is surrounded by a sleeve 126. The sleeve 126 extends into a central area 129. The central area 129 is defined by an inner diameter of the weight cap 40. Threaded axial bores 130 in the weight cylinder 42 receive bolts 132 extending through axial bores 134 in the weight cap 40. In this embodiment, assembly of an actuator is performed in the area proximally displaced from the weight cylinder 42. Therefore, the weight cap 40 is assembled to the weight cylinder 42 after the remainder of assembly of a weight collar 7 or 8 is completed. The sleeve 126 has retainers 136, i.e. apertures which will radially restrain detents 70, positioned to be in axial registration with the circumferential groove 122 when the weight collar 7 or 8 is placed on the bar 2.

In this embodiment, an actuator 140 is provided which is coaxial with and has a central axial recess receiving the sleeve 126. An outer diameter of the actuator 140 has a radial dimension to fit in the inner diameter of the weight cap 40. Biasing means, not shown, may be disposed in a space surrounding the sleeve 126 between a distal end of the actuator 140 and a proximal end of the weight cylinder 42. Each detent chamber 112 is in the actuator 140 radially outwardly of the sleeve 126. In order to place the detents 70 in each detent chamber 112, radial bores 142 are formed. Plugs 144 fill each radial bore 142 to house the detents 70. The plug 144 preferably terminates at its radially inward end in a hemispherical or otherwise scooped surface to receive the detent 70 and provide for camming as the actuator 140 is moved from the second position to the first.

Figure 9A:
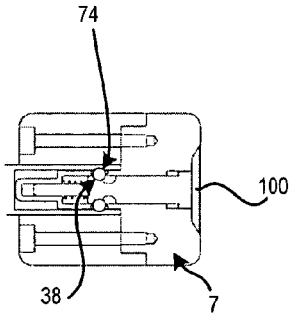
FIG. 9 consists of FIGS. 9*a*-9*e*, each of which is a cross sectional elevation illustrating operation of an embodiment.

FIG. 9 consists of FIGS. 9*a*-9*e*, each of which is a cross sectional elevation illustrating operation of the embodiment of FIGS. 5-7*a*. Operation of this embodiment is advantageous in that the weight collar 7 may be slipped on to the bar 2 without a user's having to depress the actuator 100. However, the actuator 100 must be operated by a user to remove the weight collar 7. In a steady state position, such as when the weight collar 7 is detached from the bar 2, as illustrated in FIG. 9*a*, the weight collar 7 is in a first state. In the first state, the actuator 100 is in the first position.

Figure 9B:
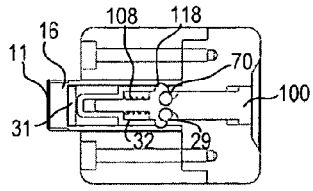
Figure 9C:
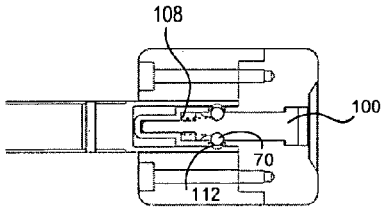
Figure 9D:
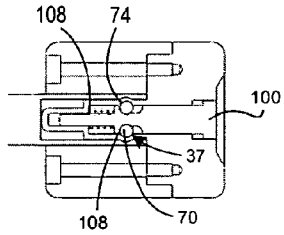

When it is desired to secure the weight collar 7 to the bar 2, the end 16 of the section 11 and the weight collar 7 are slid together. The edge 29 and then the inner wall 32 of the axial bore 31 engage the detent 70, as seen in FIG. 9*b*. The force applied to the detent 70 by the end 16 in turn forces the detent 70 against the camming surface 118. This force is greater than the force which urges the actuator 100 toward the first position applied by the biasing means 108. The resulting camming action forces axial movement of the actuator 100 until the actuator 100 is in the second position, as seen in FIG. 9*c*. Once the actuator 100 is in the second position, the detent 70 is in registration with the aperture 74 and the groove 38. Consequently, radially inward force is not transmitted to the detent 70. At this point, the biasing force exerted by the biasing means 108 through the actuator 100 to the detent 70 is no longer overcome. Consequently, the biasing means 108 pushes the actuator 100 in the proximal direction, and the camming surface 118 pushes the detent 70 radially outwardly, as seen in FIG. 9*d*. The detent 70 projects through the aperture 74 and has a portion thereof received in the circumferential groove 38. The circumferential groove 38 acts as stop means 37.

Figure 9E:
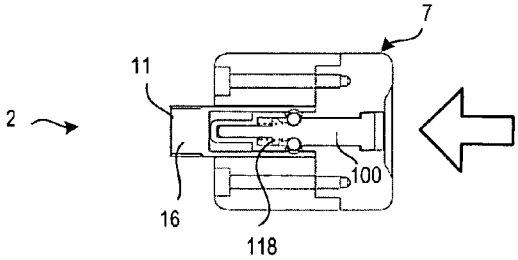

In order to remove the weight collar 7, a user applies force to press the actuator 100 against the biasing means 108, as indicated in FIG. 9*e*. The actuator 100 moves axially from the first position to the second position. Consequently, the detents are no longer forced to engage the circumferential groove 38. The user may slide the weight collar 7 off the bar 2. Once the detents 70 are surrounded by the inner wall 32, the user may stop applying force to the actuator 100.

Figure 10:
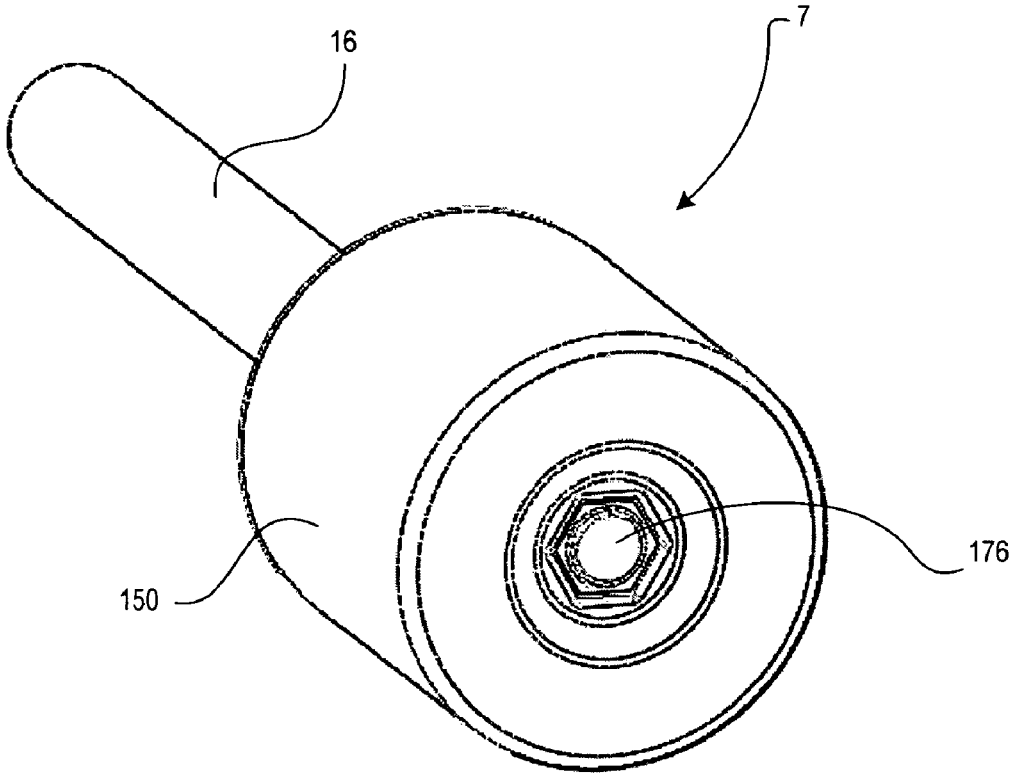
FIG. 10 is an isometric view of the weight collar engaged with the bar.
Figure 11:
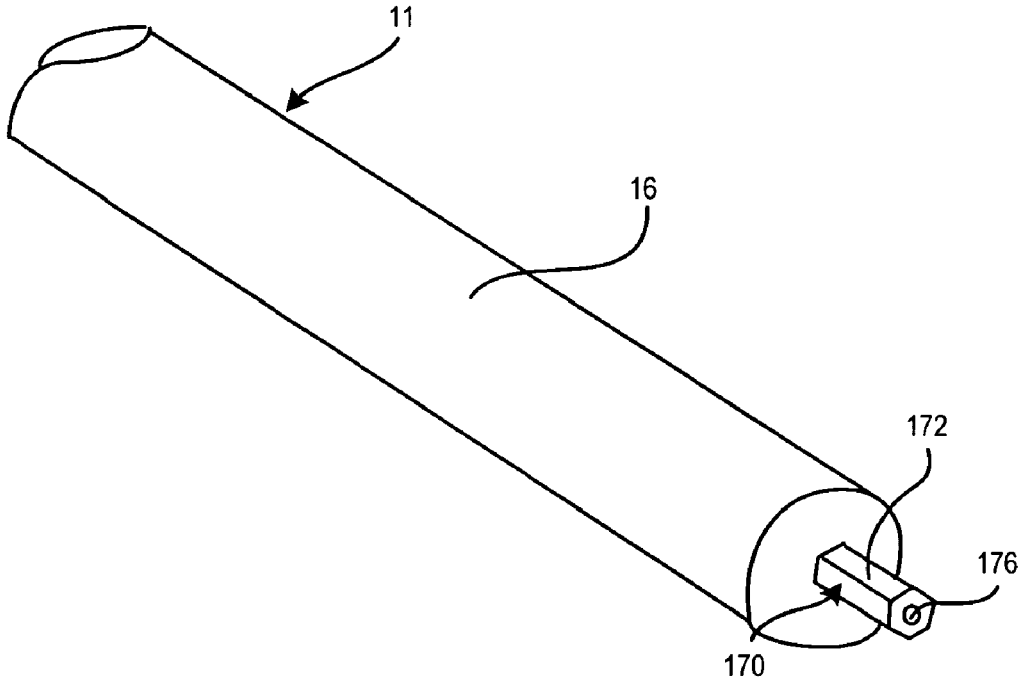
FIG. 11 is an isometric view illustrating a further form of an end of a bar to be received in a weight collar in which the actuator is included in the bar rather than in the weight collar.
Figure 12:
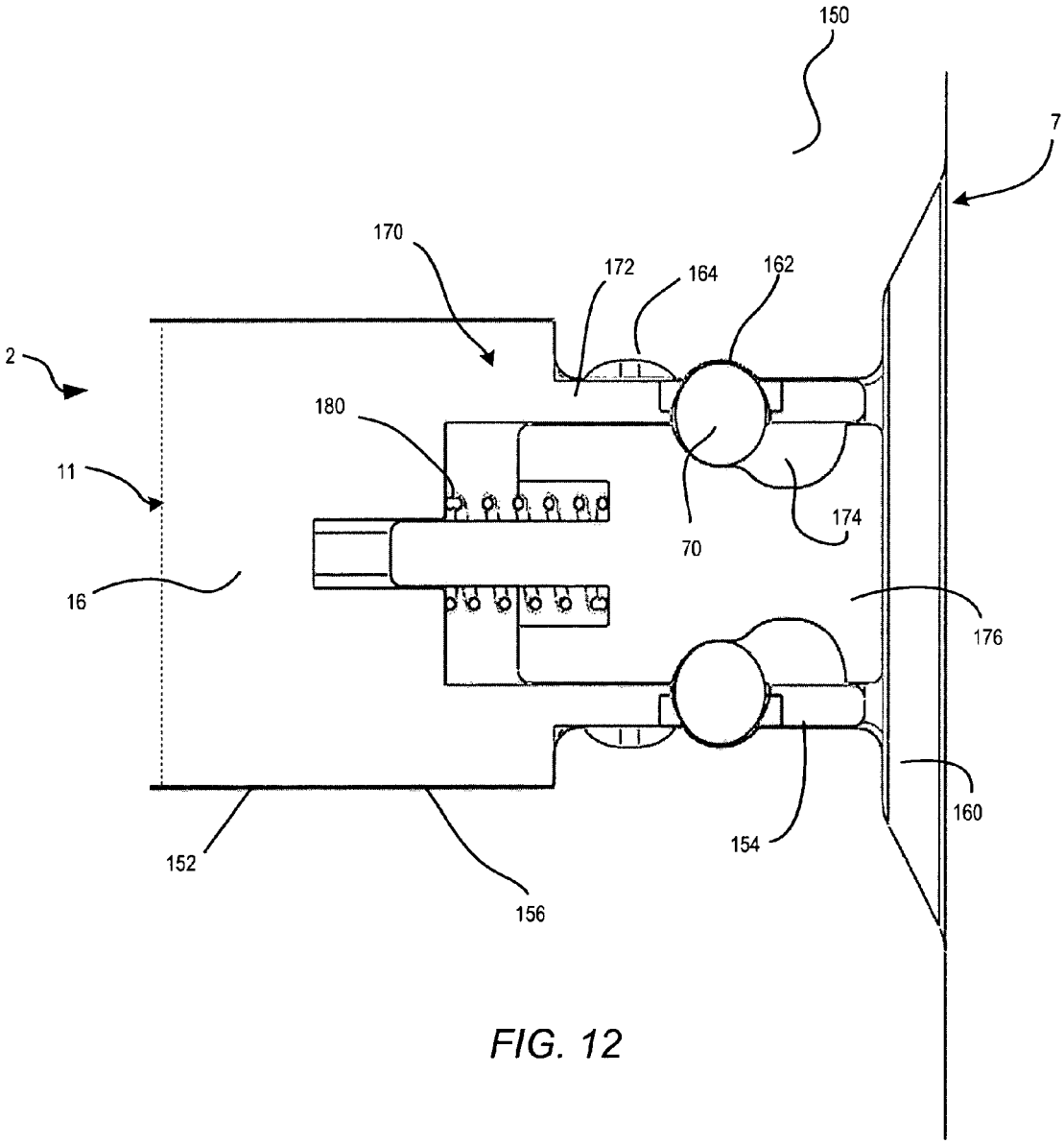
FIG. 12 is a cross sectional view of the apparatus of FIG. 11 taken along a diameter of the bar and the weight collar.

While it has been found that having the actuator 100 in the weight cap 40 may have some ergonomic advantages, if the coupling mechanism is housed in the bar 2, then only one mechanism need be provided in conjunction with a plurality of weights. Also, since a coupling mechanism does not need to be assembled in the weight collar 7, a one-piece weight collar 7 may be provided. The embodiment of FIGS. 10-12 contains a coupling mechanism in the bar 2. FIG. 10 is an isometric view of a weight collar engaged with a bar. FIG. 11 is an isometric view, partially broken away illustrating a further form of an end of a bar and a weight collar to be received on a bar in which the actuator is included in the bar rather than in the weight collar. FIG. 12 is a cross sectional view of the apparatus of FIG. 11 taken along a diameter of the bar and the weight collar. The same reference numerals are used to denote components corresponding to those in earlier embodiments. FIGS. 10-12 are discussed together.

The weight collar 7 comprises a cylinder 150. The cylinder 150 may have a stepped inner chamber 152 including a proximal section 154 and a distal section 156 which has a radial face 158 at a proximal end thereof. The proximal section 154 may have a radial cross section suited to act as an anti-rotation socket. A hexagonal cross section is a common choice. The distal section 156 comprises a circular bore for receiving the end 16 of the section 11. The cylinder 150 may have a proximal recess 160 to allow distal displacement of an actuator from the proximal end of the weight collar 7. The cylinder 150 has a first circumferential groove 162 positioned in the proximal section 154 of the stepped inner chamber 152 positioned to act as stop means for a detent 70. Additionally, a secondary groove 164 is displaced distally from the circumferential groove 162. The secondary groove 164 is a safety feature. If for some reason, detents 70 are not properly engaged in the circumferential groove 162, the weight collar 7 may move axially and fall or be projected away from the bar 2. The path of the detents 70 must traverse the secondary groove 164. The secondary groove 164 can act as stop means to prevent separation of the weight collar 7 from the bar 2.

In the present embodiment, the end 16 of the section 11 terminates in a hollow plug 170 having a radially outer surface fitting in the proximal section 154 of the stepped inner chamber 152 in the weight collar 7. The wall of the hollow plug 170 comprises a sleeve 172. The sleeve 172 may have a circular inner diameter defining a chamber 174 to house an actuator 176. The sleeve 172 and actuator 176 interact in a manner similar to the interaction of the sleeve 62 and actuator 100 of FIG. 6. In the present embodiment, the actuator 176 further comprises an annular recess 180 extending proximally into the actuator 176 and surrounding the alignment plug 106. In this manner, a longer spring may be housed within the sleeve 172 while utilizing the same axial dimensions for other components as in FIG. 5.

Figure 13A:
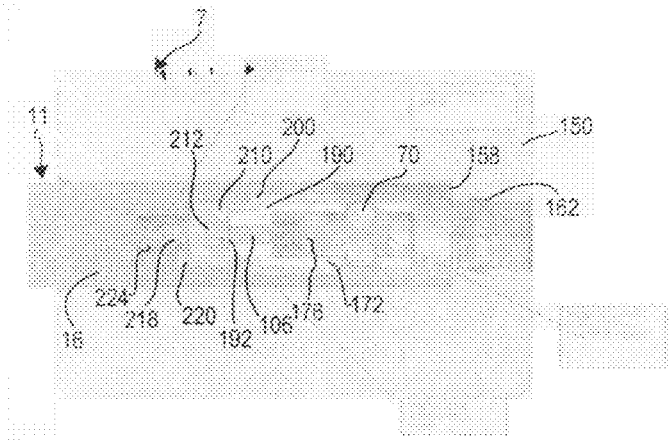
FIG. 13 consists of FIGS. 13*a*-13*c*, each of which is a cross sectional elevation in which structure and operation of an embodiment including a magnetic latch are illustrated.
Figure 13B:
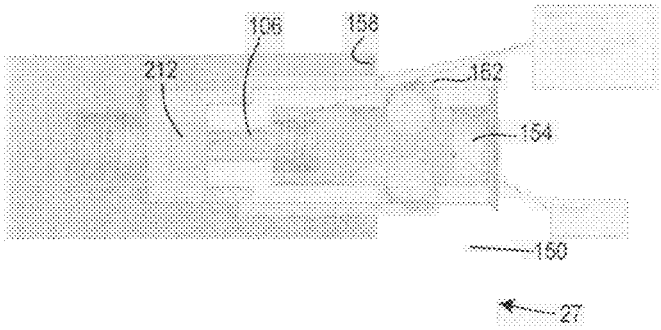
Figure 13C:
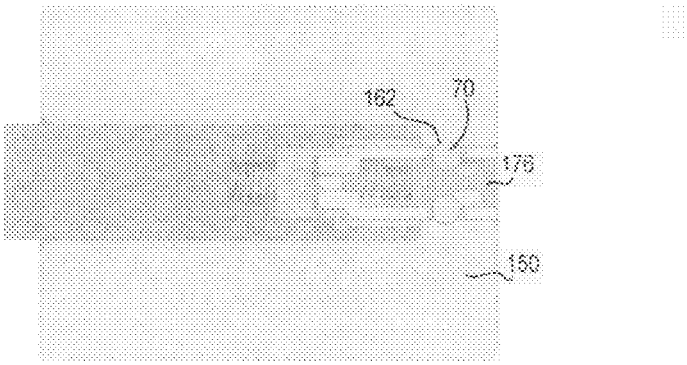

FIG. 13 consists of FIGS. 13*a*-13*c*, each of which is a cross sectional elevation in which structure and operation of an embodiment including a magnetic latch are illustrated. The same reference numerals are used to denote components corresponding to those in the embodiment of FIGS. 10-12. In the present embodiment, the sleeve 172 is not unitary with the section 11. The sleeve 172 is a stepped sleeve having a reduced diameter distal end 190. The distal end 190 has an alignment socket 192 which receives the alignment plug 106 and which is open at a distal end. In this embodiment, the alignment plug 106 is made of magnetically susceptible material or has an insert which will be attracted by a magnet. The depth of the alignment socket 192 is preferably selected so that a distal end of the alignment plug 106 is substantially in axial alignment with the open, distal end of the alignment socket 192 when the actuator 176 reaches its maximum distal displacement.

The sleeve 172 is slidable within and nests with a magnet-bearing sleeve 200. The magnet-bearing sleeve 200 has a reduced diameter base 210 at a distal end thereof which will abut or be closely positioned next to the distal end 190 of the alignment socket 192 when the sleeve 172 reaches its maximum extent of distal movement with respect to the magnet-bearing sleeve 200. The base 210 houses a magnet 212 at a proximal end thereof. In the latched position, the magnet 212 holds the actuator 176 in place, overcoming the force of the biasing means 108.

The magnet-bearing sleeve 200 in turn is slidable in and nests with a stepped socket 220 in the end 16 of the section 11. A biasing means 224, such as a coil spring, is positioned to bias urging the magnet-bearing sleeve 200 in a proximal direction. The biasing means 224 may surround an alignment boss 218 projecting distally from the magnet-bearing sleeve 200.

FIG. 13*a* illustrates an initial state prior to the weight collar 7 being placed on the bar 2. The actuator 176 is either already in the latched state, or the actuator 176 is pushed distally by a user to be in the latched state. When the actuator 176 is in the latched state, it is in its second, i.e., disengaged, position. The magnet 212 engages and holds the alignment plug 106. To secure the weight 7 to the bar 2, the user slides the weight cylinder 150 coaxially and distally with respect to the end 16 of the section 11. As the weight collar 7 is pushed distally with respect to the end 16, a proximal radial face 158 of the distal section 154 of the inner chamber 152 approaches the magnet-bearing sleeve 200. The magnet-bearing sleeve preferably has an inner diameter substantially equal to that of the inner, radial face 158, as illustrated in FIG. 13*b*.

When the weight collar 7 and section 11 reach the relative position, as shown in FIG. 13*b*, the radial face 158 engages the magnet-bearing sleeve 200. As the user continues to move the weight collar 7 axially distally, the face 158 pushes the magnet 212 away from the alignment plug 106. When the magnet 212 reaches a preselected axial distance from the alignment plug 106, the axial force applied by the biasing means overcomes the force exerted by the magnet 212. At this point, the biasing means 108 urges the actuator 176 into the first position, illustrated in FIG. 13*c*. In the first position, the detents 70 engage stop means, e.g., the circumferential groove 162 in the weight collar 7, and the weight collar 7 is secured to the bar 2.

In order to disengage the weight collar 7, a user 7 pushes the actuator 176 distally until the actuator 176 becomes latched, i.e., held in its second, i.e., disengaged, position, illustrated in FIG. 13*a*. Then the weight collar 7 may be conveniently slid off the bar 2.

Figure 14:
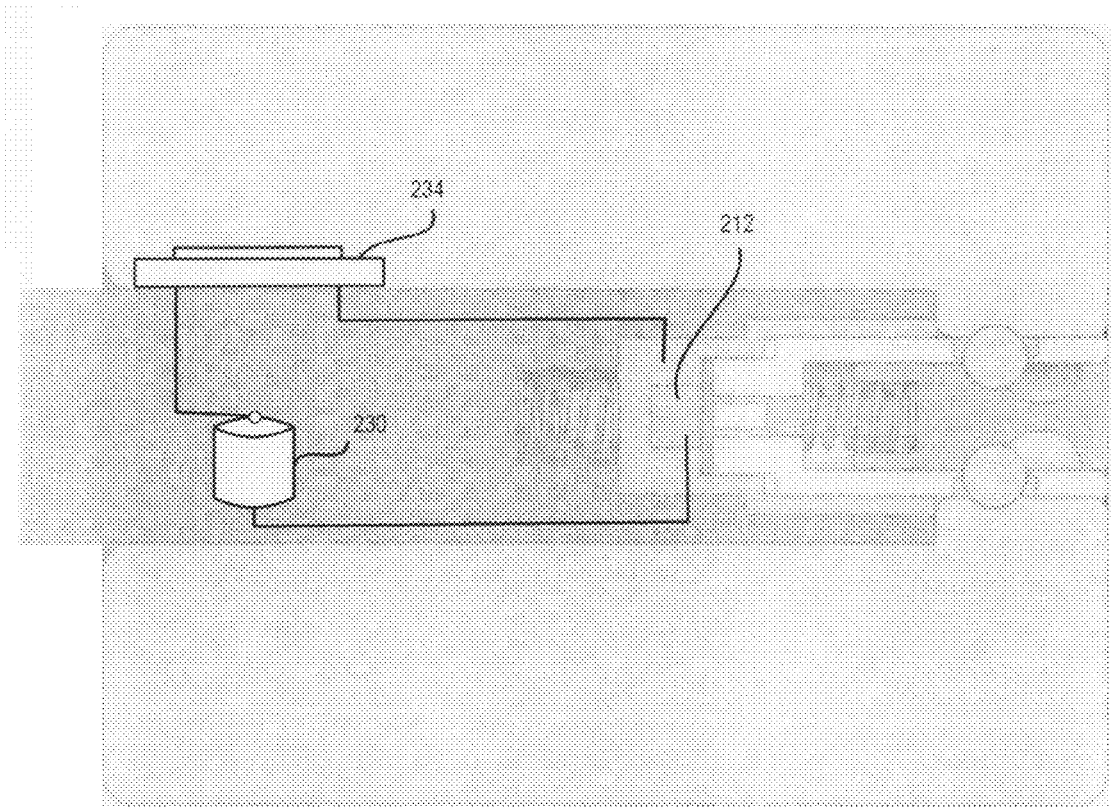
FIG. 14 is a cross sectional elevation of an embodiment including an electromagnetic latch.

FIG. 14 is a cross sectional elevation an embodiment including an electromagnetic latch. In FIG. 14, the magnet 212 is an electromagnet. A power source 230, e.g., a rechargeable battery, may be housed in a portion of the section 16. A switch 234, which, for example, may be a switch that toggles when depressed or which is on only when depressed. The electromagnet 212 may be energized to permit latching only in selected situations.

Figure 15:
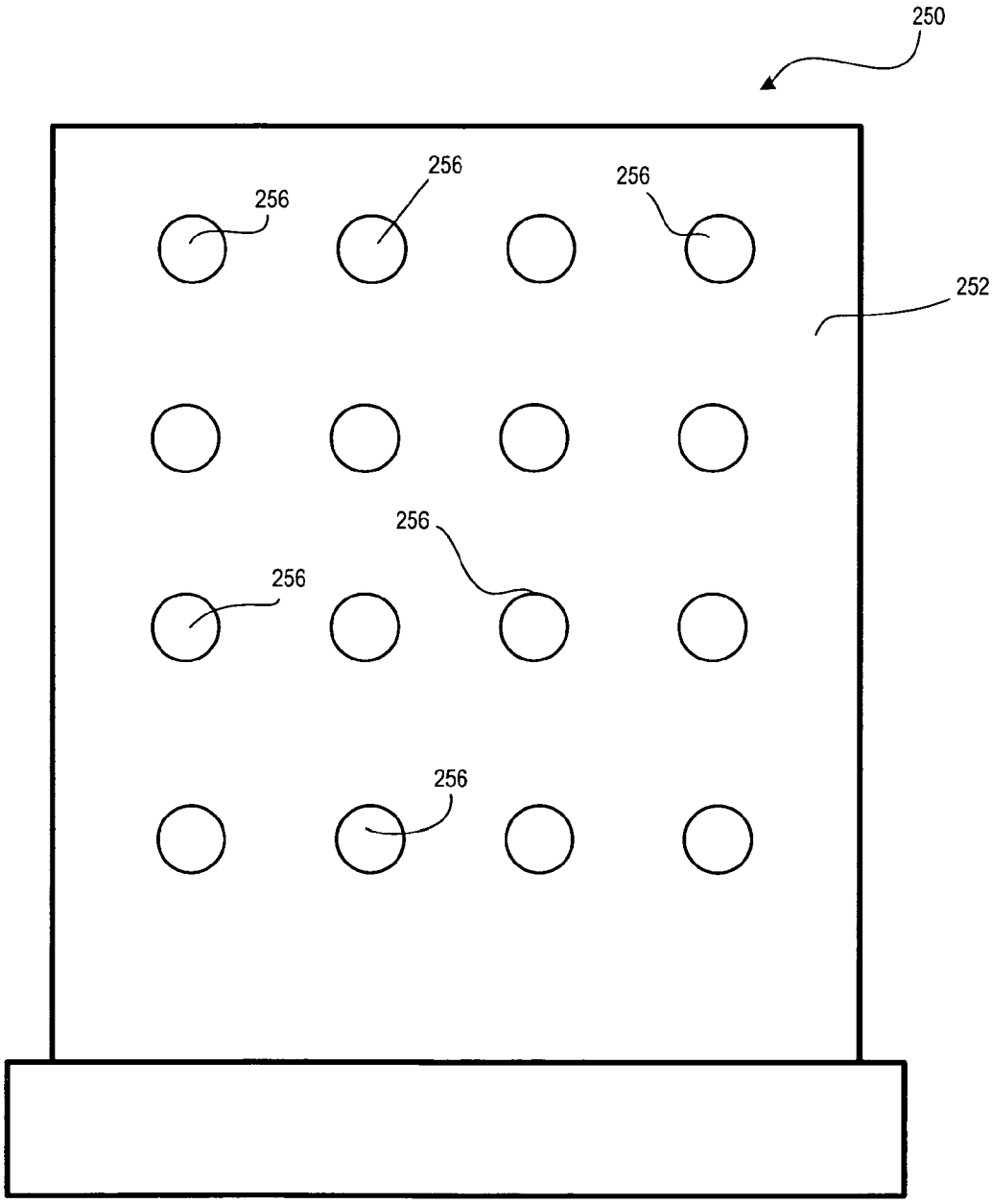
FIGS. 15 and 16 are respectively a front and a side elevation illustrating a weight support system interacting with a set of weights.
Figure 16:
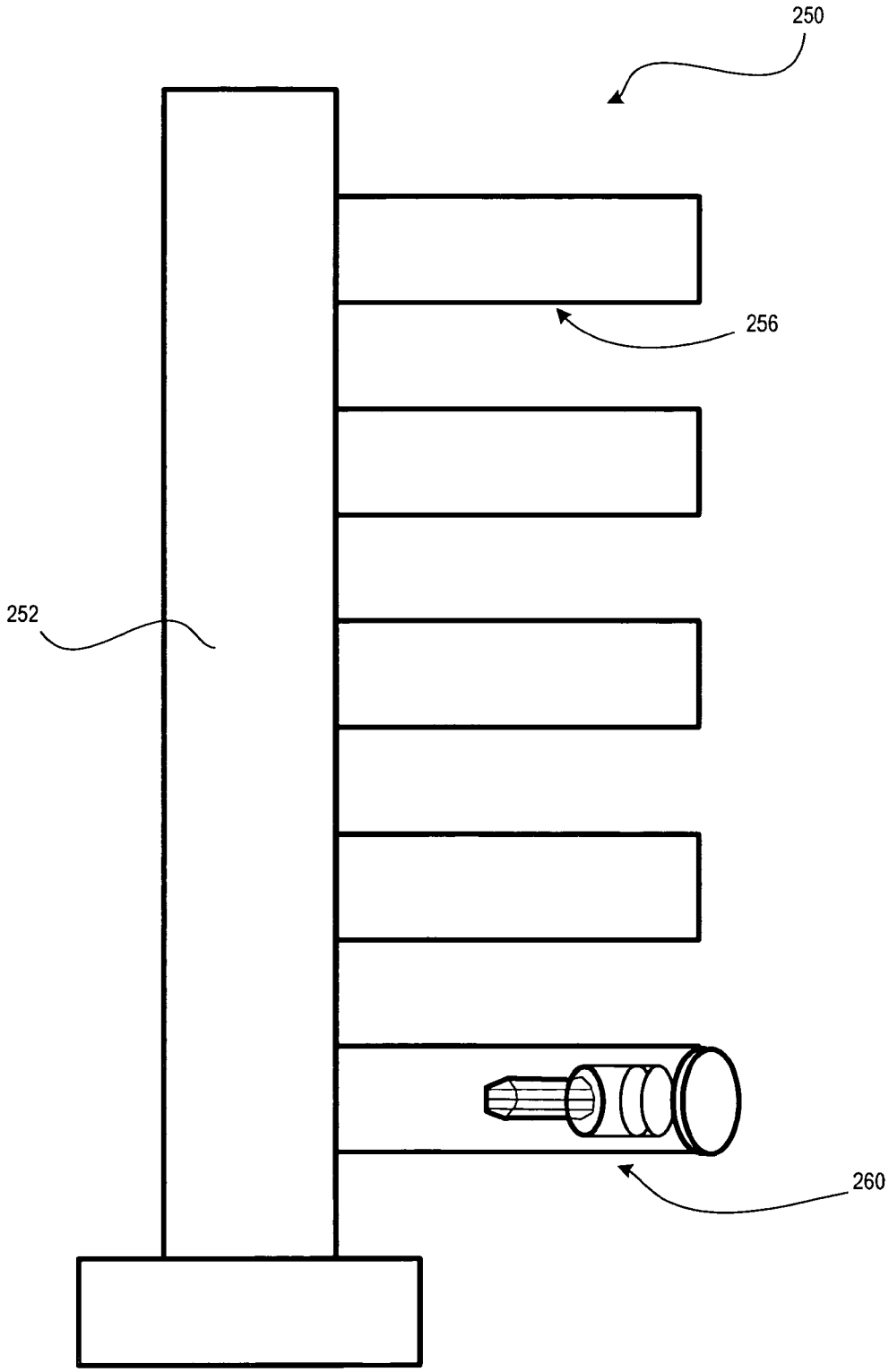

FIGS. 15 and 16 are respectively a front and a side elevation illustrating a weight support system 250 interacting with a set of weights. The weight support system comprises a mounting board 252 having a plurality of weight mounts 256 projecting therefrom. Each weight mount 256 is shaped to fit within a cylindrical envelope. The weight mount 256 receives a weight collar 7 or 8. In one form, the weight mount 256 simulates an end of the bar 2 and may be coupled to a weight collar 7 or 8 in the same manner as a bar 2, an example of which is shown as weight mount 260. The weight support system 250 provides a reliable form of mounting weights and makes them accessible to users. The ease of utilizing the system 250 will encourage users at public exercise facilities to return weights to their proper place after use. Proper coupling of weights to the weight board 252 reduces the chance of accidental dropping of weights, thus providing additional safety in weight use.

The present subject matter being thus described, it will be apparent that the same may be modified or varied in many ways. Such modifications and variations are not to be regarded as a departure from the spirit and scope of the present subject matter, and all such modifications are intended to be included within the scope of the following claims.

What is claimed is:

1. An exercise bar for a releasable collar, comprising:

an elongated bar having an outer diameter to receive a collar over an outer surface at an end of said elongated bar and, the end of said elongated bar surrounding an axially extending first bar recess communicating with an exterior of the end of said elongated bar at a proximal end of said first bar recess, said first bar recess having an inner diameter;

an actuator comprising a generally cylindrical body axially movable within said first bar recess;

at least one actuator recess formed in said actuator having a first depth along a first axial extent and a second depth along a second axial extent of said actuator recess, said first depth being less than the radial dimension of a detent means and said second depth being at least equal to a radial dimension of a detent means;

a detent means housed in each said recess;

stop means radially adjacent said detent means, wherein said detent means engages said stop means when said actuator is in a first axial position wherein said first axial extent of said actuator recess is axial registration with said stop means; and biasing means biasing said actuator with respect to said elongated bar for maintaining said actuator in said first axial position; and an axial projection extending from said actuator away from the end of said elongated bar and a second bar recess extending from said first recess substantially coaxially therewith to receive the axial projection.

2. The exercise bar according to claim 1, wherein said axial projection and said second bar recess are shaped to prevent relative rotation.

3. The exercise bar according to claim 2, wherein said second bar recess comprises a socket for said axial projection.

4. The exercise bar according to claim 1, further comprising biasing means positioned between said actuator and a distal end of said first bar recess.

5. The exercise bar according to claim 4, wherein said biasing means comprises a coil spring surrounding said axial projection, and a distal end of said actuator comprises an annular recess concentric with said axial projection to receive a proximal end of said coil spring.

6. The exercise bar according to claim 1, wherein each stop means comprises an annular insert.

7. The exercise bar according to claim 1 further comprising a latch in said elongated bar releasably engaging said actuator when said actuator is in said second axial position.

8. The exercise bar according to claim 7, wherein said latch comprises a magnet in said elongated bar axially adjacent a distal end of said axial projection when said actuator is in said second axial position.

9. The exercise bar according to claim 8, wherein said magnet is an electromagnet.

10. The exercise bar according to claim 8, further comprising:

an axially extending sleeve intermediate said actuator and including said first bar recess, a second sleeve surrounding said first sleeve and received in the end of said elongated bar, said second sleeve including said magnet latch;

biasing means biasing said second sleeve axially against said first sleeve;

said second sleeve being axially displaceable against said biasing means to separate said magnet from said axial projection and unlatch said actuator.

11. The exercise bar according to claim 10, wherein said second sleeve has a portion positioned outside the elongated bar to engage and be moved by a collar placed over the end of said elongated bar.

12. The exercise bar according to claim 1, further comprising a collar having a central aperture to receive the end of said elongated bar, said collar further comprising a first stop means to receive said detent means when said collar is in said first axial position.

13. The exercise bar according to claim 12, wherein a proximal end of said actuator comprises a button accessible through said central aperture in said collar, wherein said collar further comprises a second stop means axially displaced from said first stop means to engage said detent means if said detent means should disengage from said first stop means.

14. The exercise bar according to claim 12, wherein said collar further comprises a second stop means axially displaced from said first stop means to engage said detent means if said detent means should disengage from said first stop means.

15. The exercise bar according to claim 12, wherein said elongated bar comprises a central curved section to extend behind a neck of a user and further comprises first and second axially extending arms extending in opposite directions from said central section for grasping by a user, said end of said elongated bar comprising an end of said first axially extended arm and wherein said second axially extended arm has an end to receive a second collar.

16. The exercise bar according to claim 15, wherein said central curved section and said first and second axially extending arms comprise detachably secured sections.

17. The exercise bar according to claim 16, further comprising threaded ends to secure adjacent detachably secured sections.

18. The exercise bar according to claim 16, further comprising a plug and a socket respectively at ends of adjacent sections to secure said section.

19. An exercise bar for a releasable collar, comprising:

a collar having a distal portion to engage an elongated bar;

an actuator positioned in a central recess of said collar and communicating with a distal end of said collar, said collar being axially movable in said central recess;

said actuator comprising a generally cylindrical central section at a distal end thereof to couple with an end of said elongated bar, and further comprising a circumferential recess formed on an inner diameter of said actuator, said circumferential recess having a first depth along a first axial extent and a second depth along a second axial extent of said circumferential recess, said first depth being at least equal to a radial dimension of a detent means and said second depth being less than the radial dimension of a detent means;

a detent means housed in said circumferential recess;

retaining means comprising at least an aperture communicating said circumferential recess with an exterior of said elongated bar, wherein said detent means projects through said retaining means when said actuator in a first axial position wherein said second axial extent of said circumferential recess is in axial registration with a stop means;

said stop means radially adjacent said retaining means; and biasing means biasing said actuator with respect to said collar for maintaining said actuator in said first axial position, wherein said distal portion of said collar comprises a bore to receive said elongated bar and wherein said first central recess is surrounded by a cylindrical portion of said collar at a proximal end, said cylindrical portion is received in said central section of said actuator, and wherein said stop means are formed in said cylindrical portion.

20. The exercise bar according to claim 19, further comprising antirotation means to prevent relative rotation of a weight collar and said elongated bar.

21. The exercise bar according to claim 20, wherein said collar antirotation means comprises said first central recess being formed as a socket.

22. The exercise bar according to claim 19, wherein said collar comprises first and second axially adjacent annular sections, said second annular section comprising said second central recess.

23. The exercise bar according to claim 22, wherein said first central recess is stepped to receive an end of an annual bar having a reduced diameter at a proximal end.

24. The exercise bar according to claim 23, further comprising an annual bar received in said first recess, said annular bar having a stop means alignable in registration with said stop means.

* * * * *